United States Patent [19]

Miller

[11] Patent Number: 4,740,305

[45] Date of Patent: Apr. 26, 1988

[54] METHOD AND APPARATUS FOR TREATMENT OF A PERMEABLE WEB WITH A FLUID

[76] Inventor: Ray R. Miller, 8816 Warren Dr. NW., Gig Harbor, Wash. 98335

[21] Appl. No.: 922,245

[22] Filed: Oct. 23, 1986

[51] Int. Cl.[4] ..... B01D 33/04; D06B 5/08

[52] U.S. Cl. ..... 210/783; 8/149.3; 8/151; 15/306 A; 34/115; 68/5 E; 68/45; 68/181 R; 210/401

[58] Field of Search ..... 8/149.3, 151, 156; 68/5 D, 5 E, 8, 22 R, 45, 181 R; 15/306 A; 34/115, 123; 162/358; 210/401, 783

[56] References Cited

U.S. PATENT DOCUMENTS

| | | | |
|---|---|---|---|
| 2,552,078 | 5/1951 | Williams | 68/22 R X |
| 2,753,181 | 7/1956 | Anander | 15/306 A X |
| 3,199,317 | 8/1965 | Walsh | 68/22 R |
| 3,616,660 | 11/1971 | Ingermarsson | 68/22 R |
| 4,011,623 | 3/1977 | Pabst et al. | 15/306 A |
| 4,088,581 | 5/1978 | Carle | 210/401 X |
| 4,194,947 | 3/1980 | Huostila et al. | 162/207 |
| 4,199,966 | 4/1980 | Winch | 68/22 R |
| 4,277,860 | 7/1981 | Sando et al. | 8/151 |
| 4,292,123 | 9/1981 | Lintunen et al. | 162/60 |
| 4,366,025 | 12/1982 | Gordon, Jr. et al. | 162/358 |

FOREIGN PATENT DOCUMENTS

| | | | |
|---|---|---|---|
| 2910483 | 9/1980 | Fed. Rep. of Germany | 68/181 R |

OTHER PUBLICATIONS

Applicant's pending application Ser. No. 849,931, filed Apr. 8, 1986.

*Primary Examiner*—Philip R. Coe
*Attorney, Agent, or Firm*—Keith D. Gehr

[57] ABSTRACT

The invention is a method and apparatus for treating a permeable web with a fluid. The apparatus has a rotatable drum with a fluid permeable endless belt reeved about at least a portion of the drum circumference. Two or more spaced-apart press rolls bear against the outer surface of the belt, pressing it against the drum with sufficient force to form nip zones. A belt position control mechanism gives the belt limited freedom of radial movement away from the drum in the area between the nip zones. This permits a gap of controllable dimension to form between the drum and the belt. The gapped region defines a volume which creates a permeable web treating zone. The drum surface has at least one row of spaced apertures located entirely around its circumference. These apertures communicate with a fluid supply system which can supply treating fluid under pressure outwardly through the surface apertures into the treating zones between the press rolls. Seals between the edges of the belt and the drum prevent fluid leakage along the belt margins. A conventional driving apparatus completes the apparatus. In use, the web of material being treated is passed between the moving belt and rotating drum. Treating fluid under pressure is directed outwardly through the drum apertures against the drum facing surface of the web as it passes through the treating zone.

24 Claims, 6 Drawing Sheets

Fig. 7
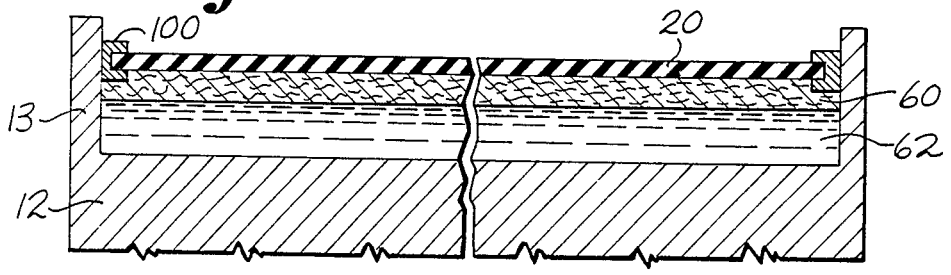
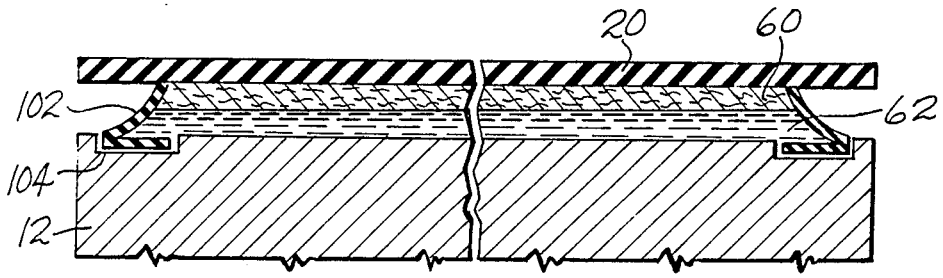
Fig. 8
Fig. 9
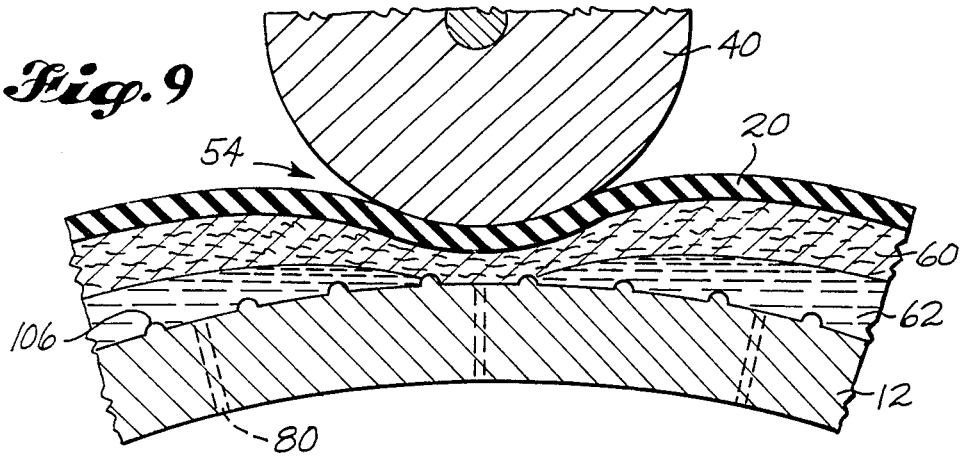

Fig. 10
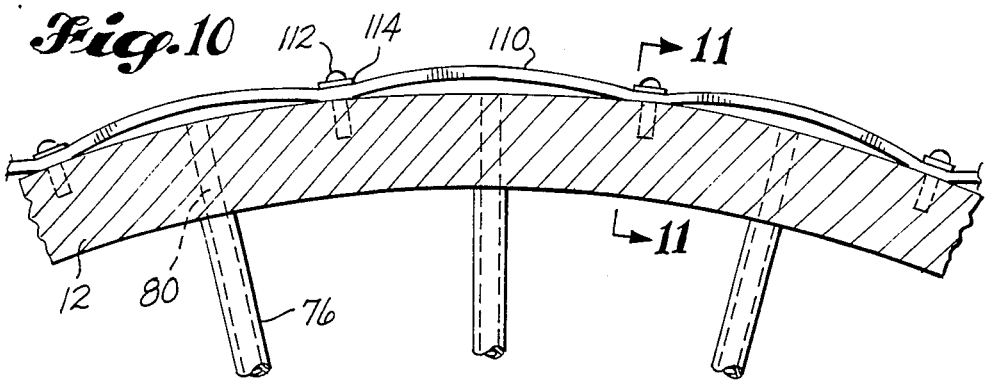
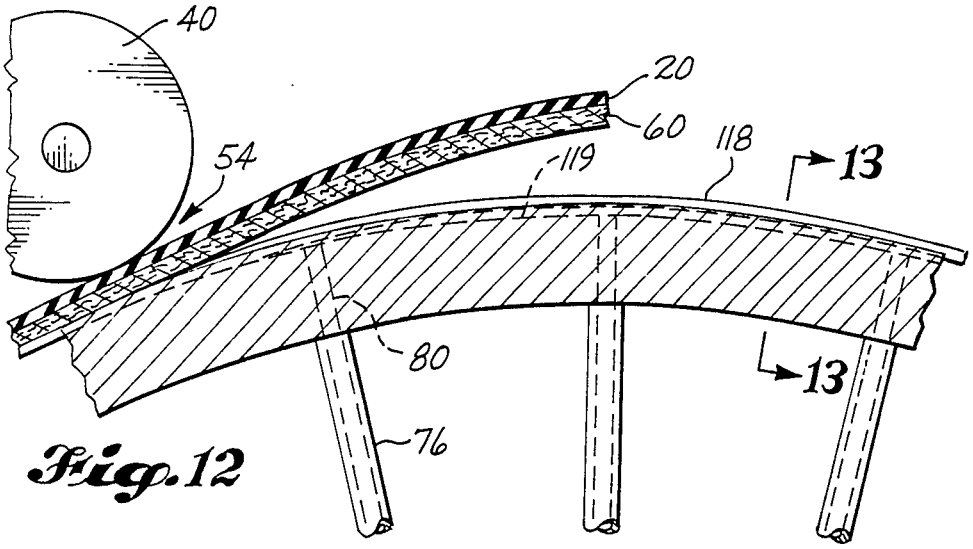
Fig. 12
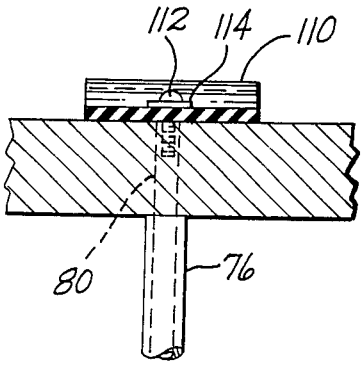
Fig. 11
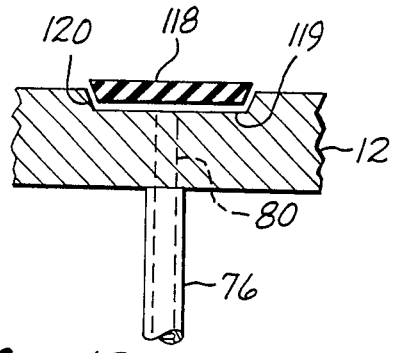
Fig. 13

METHOD AND APPARATUS FOR TREATMENT OF A PERMEABLE WEB WITH A FLUID

BACKGROUND OF THE INVENTION

The present invention relates to a method and apparatus for treating a permeable web material with a fluid. The fluid may be used for displacement washing of the web, it may be a reactive material such as a bleach or dye, or it may be some other type of treatment.

A number of different generic types of apparatus are known for treatment of woven or non-woven webs with various fluid materials. One very common type is the vacuum drum. Here a web of material is run onto the porous surface of a drum and fluid is flowed onto the material from external showers. Vacuum boxes or other means for creating a reduced pressure within the drum draw the fluid through the web. Alternatively, the web may be formed on the drum from a slurry of fibrous material prior to treatment. One or more press rolls may bear against the drum to assist in fluid removal. An alternative but similar form of apparatus uses a shroud enclosed drum which is pressurized on the outside. In this case the pressure is generally quite low, typically in the range of 15 to 30 kPa. In another type of treatment apparatus the web is held between two fluid permeable parallel wires supported on or between a series of small diameter press rolls. Fluid can be showered on the web between the press rolls.

To show some specific examples of apparatus for treating permeable webs, Sando et al., U.S. Pat. No. 4,277,860, show a woven cloth carried between opposing fluid permeable belts immersed in a treating fluid. Staggered opposing nozzles placed under the fluid and outside the belts spray hot fluid onto both surfaces of the cloth as it passes through the fluid bath.

Lintunen et al., U.S. Pat. No. 4,292,123, show a washer for a continuous web of cellulose pulp. The pulp is formed into a wet sheet or mat on a simple forming wire prior to contacting the outer surface of a fluid permeable rotating drum. The drum is surrounded by a plurality of washing stations which are spaced a sufficient distance from the drum surface to accommodate the pulp web. Washing fluid is introduced, preferably in countercurrent fashion, where it then flows through a foraminous surface in the washer stations, through the pulp, and then into a collection zone into the interior of the drum.

Walsh, U.S. Pat. No. 3,199,317 shows a fabric or similar material being carried on a moving endless belt having a concave portion dipping into a pool of treating fluid. The fabric emerges from the bath and passes, while still on the belt, between a pair of rollers that squeeze out excess fluid.

Winch, U.S. Pat. No. 4,199,966, show a web being carried on an endless perforated belt through a tank of fluid. A series of rollers are placed alternately above and below the belt so that it travels a somewhat sinuous path. As the web on the belt passes under a roller it is lightly squeezed. As the belt passes over the adjacent roller the web expands. Fluid may be passed through the tank in countercurrent fashion to effect washing or other treatment.

Many of the devices just described, while being well suited for some specific purpose for which they were designed, have serious shortcomings when used with other materials or for different types of treatments. Among these shortcomings are the need for large quantities of treating fluid, with attendant expensive collection and pumping equipment, and discharging a treated mat which is still very wet and contains a large amount of entrained treating fluid.

My earlier U.S. patent application, Ser. No. 849,931, filed Apr. 8, 1986, is hereby incorporated by reference. There are certain common features shared by the pressing device of the earlier application and my present apparatus which is used for treatment of a permeable mat with a fluid. The earlier described device is not suitable for the latter purpose without the major modifications and improvements now to be described.

SUMMARY OF THE INVENTION

The present invention relates to a method for continuously treating a permeable web with a fluid and to an apparatus for carrying out the treatment. The apparatus comprises a rotatable drum having a fluid permeable endless belt reeved about at least a portion of the drum circumference. At least two spaced-apart press rolls bear against the outer surface of the belt pressing it against the drum with sufficient force to form nip zones. A belt position control mechanism gives the belt limited freedom of radial movement away from the drum in the area between nip zones. This permits a gap of controllable dimension to form between the drum and the belt. The gapped region defines a volume which comprises a permeable web treating zone. The drum surface is provided with at least one row of spaced-apart apertures located entirely around the circumference of the drum. These apertures are in communication with a fluid supply system which can supply treating fluid under pressure outwardly through the surface apertures into the treating zone between the press rolls. In order to prevent fluid leakage along the belt margins it is necessary to provide seals which act between the edges of the belt and the drum. A conventional driving mechanism for the belt and/or drum completes the basic apparatus.

In operation a fluid permeable web of the material to be treated is continuously passed between the moving belt and rotating drum. Treating fluid under pressure is directed outwardly through the drum apertures against the drum facing surface of the web as it passes through the treating zone. The treating zone itself becomes pressurized and the run of belt between the press rolls reacts against the pressurized treating fluid to retain the pressure. This pressure causes the belt to assume a catenary-like configuration between the press rolls with the height of the catenary being determined by the belt position control mechanism. The gap must be sufficiently large to permit a pool of fluid to form between the web and drum when the web is forced against the belt by the pressure of the treating fluid. Formation of this pool is essential since it permits both lateral and circumferential flow of the treating fluid and assures uniform contact between the treating fluid and the entire surface of the mat contained within the treatment zone.

The treating fluid may be water, steam, air, bleaching chemical, dye, or any liquid or gas appropriate to the specific treatment being carried out.

In a preferred form the apertures on the drum surface will be provided with a check valve mechanism to prevent back flow of treating fluid into the supply lines.

Either a single row or a plurality of rows of apertures may be provided on the drum surface. Normally a single row is all that is necessary since a pool of fluid under the mat being treated provides for simple, uniform distribution of the fluid from a minimum number of apertures in the drum surface.

Within a treating zone there is normally little or no contact between the mat and the drum surface except at the nip zones at either end of the treating zone. This absence of mechanical contact permits the web to expand. The expansion normally increases web permeability, and it also permits the web to take up more fluid. The increased permeability reduces pressure drop across the web and permits more fluid to pass through the web at a given treating fluid pressure. The increased fluid flow and mat/fluid contact enhances the operation being carried out whether it is washing, chemical reaction, or some similar treatment.

It is within the scope of the present invention to use only two spaced-apart press rolls and create a single treatment zone or a plurality of press rolls to create a number of sequential treatment zones. In the latter case it will often be desirable to provide a mechanism for collecting expressed fluid from one treatment zone to recycle or return it to another treatment zone to provide either concurrent or countercurrent treatments. In either case the treating fluid is normally supplied to the drum apertures through a rotary valve. This valve may be segmented in known fashion to supply treating fluid to the treating zones.

Where the treatment zone encompasses more than half of the circumference of the drum it is possible for the drum to be free floating and supported solely by the press rolls acting through the belt. In one version of the invention two adjacent press rolls, one at each end of the treating zone or zones, may be made relatively translatable a limited distance toward or away from each other to control belt position.

The endless belt may be supported in part by rolls spaced away from the drum that do not create nip zones. Alternatively, it may be supported entirely by the press rolls. In this case, as has been just described, two of the press rolls are relatively translatable. These serve the dual service of providing nip zones and controlling belt position. Where the drum is free floating the distance between these position control press rolls must always be less than the diameter of the drum. Further, the nips zones formed by these press rolls divide the drum circumference into major and minor portions with the major portion encompassing more than 180° of angle. At least one additional idling press roll is located adjacent the drum along the major portion of the drum circumference between the two belt position control press rolls. A single idling press roll will create two treatment zones between the position control press rolls. In similar fashion, each additional press roll will create an additional sequential treatment zone. The drum must have freedom of movement so as to maintain full contact with both belt position control rolls at any time when the distance between them may be changed. Also, the idler press roll or rolls must be free to move radially with respect to the drum so as to maintain full contact against the drum during such movements. In a construction of this type all of the press rolls serve the further function of maintaining belt spacing within the belt loop. An outer portion of the belt loop will continually exert a radially directed force on the idler press rolls. This force maintains idler press roll pressure at its contact point where it forces the inner run of the belt loop against the drum surface. Optionally, a supplementary mechanism may be used in concert with the idler press rolls to increase the nip force over and above that provided solely by belt tension.

It is an object of the invention to provide an apparatus for continuously and effectively treating a permeable web with a fluid.

It is another object to provide an apparatus as described which creates web treatment zones between a rotating drum and a moving belt spaced away from the drum.

It is a further object to provide a treatment apparatus in which treatment zones are defined between a moving belt and rotating drum between spaced-apart press rolls which create nip zones between belt and drum.

It is still another object to provide an apparatus of the type described having a plurality of sequential treatment zones.

It is yet a further object to provide an apparatus of the type described in which the drum may be made free floating to simplify mechanical construction.

It is an additional object to provide a method for treatment of a fluid permeable web using an apparatus of the type described in which web treatment zones are created between a rotating drum and movable belt.

These and many other objects will become readily apparent to those skilled in the art upon reading the following detailed description taken in conjunction with the drawings.

BRIEF DESCRIPTION OF THE DRAWINGS

FIGS. 7 and 8 are sections similar to that of FIG. 2 showing alternative embodiments of marginal belt seals.

FIG. 9 is a partial sectional view in side elevation showing an alternate form of drum surface intended to reduce fluid flow from the nip zone into the treating zone.

FIG. 10 is a fragmentary sectional view in side elevation showing one check valve system for preventing reverse flow of treating fluid.

FIG. 11 is a fragmentary sectional view taken along line 11—11 of FIG. 10.

FIG. 12 shows an alternative check valve system.

FIG. 13 is a fragmentary sectional view taken along line 13—13 of FIG. 12.

DESCRIPTION OF THE PREFERRED EMBODIMENTS

Figure 1:
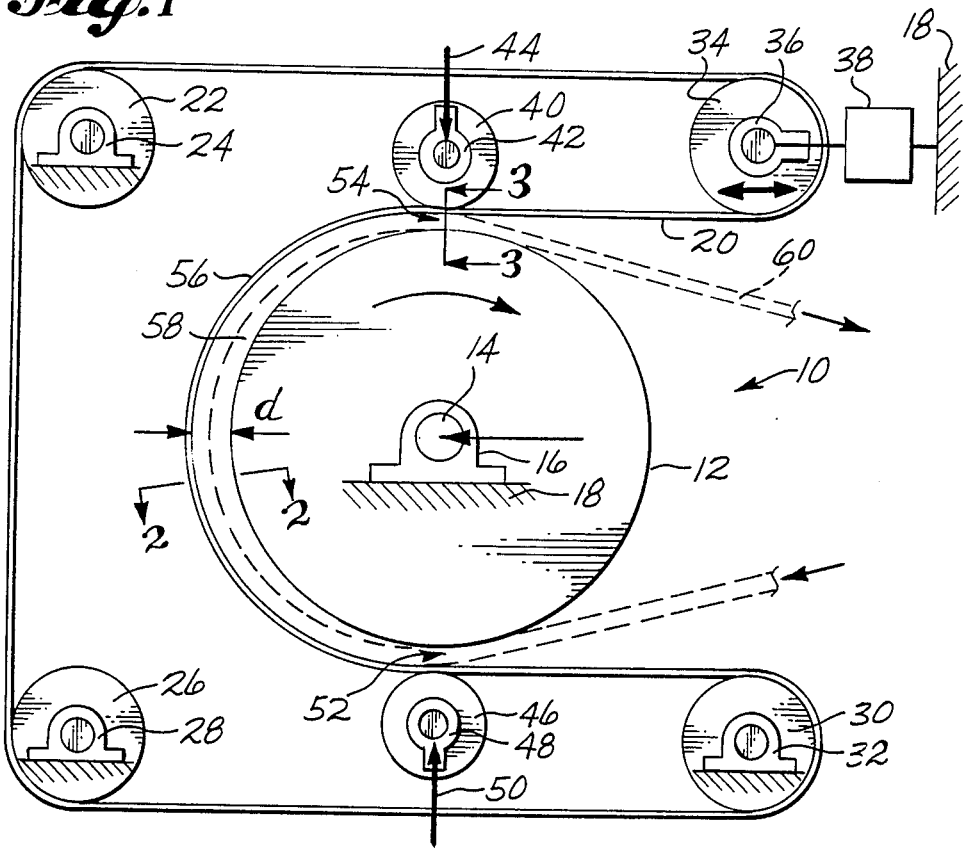
FIG. 1 is a representational side elevation view of one embodiment of the treating apparatus.

Reference should now be made to the figures which will now be described in detail. One form of the treatment apparatus, seen in FIG. 1, is generally indicated at 10. This consists of a centrally located rotary drum 12 running on shaft 14 which is journalled in a pillow block bearing 16. The bearing is supported on a frame member 18 which is indicated only in fragmentary form to simplify the drawing. An endless fluid permeable belt 20 is reeved about the drum. This belt is supported on fixed idler rolls 22, 26, 30 which are, in turn, journalled in bearings 24, 28, 32 attached to the frame. A fourth idler roll 34 serves as a belt position control roll. This is held in bearing 36 which, in turn, is attached to frame 18 through a position control device 38. Nip rolls 40, 46 are included within the belt loop. These are held respectively in bearings 42, 48 and are connected to any conventional device for applying force directed along a drum radius, as is indicated by directional arrows 44, 50. The nip rolls create nip zones 52, 54 where they press belt 20 against drum 12. Belt position control roll 34 must be adjustable so that the loop of belt 56 reeved around drum 12 can form a gap of dimension d with the drum and create a volume 58 which serves as a treating zone. In operation the run of belt 56 reeved about drum 12 between nip or press rolls 40, 46 assumes a catenary-like configuration if it is not reeved around more than 180° of drum circumference. The distance d of the gap between the catenary configured belt and drum 12 is controlled by the position of control roll 34. A web 60 being treated, shown here in phantom form, passes into the treating zone 58 at nip zone 52 and emerges from the treating zone at nip zone 54.

Figure 4:
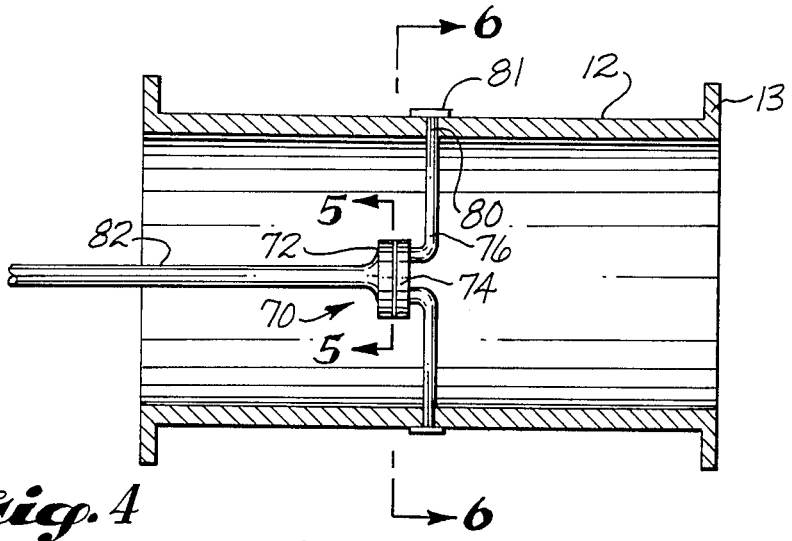
FIG. 4 is a partial sectional view of a suitable rotary supply system for treating fluid.

Reference to FIG. 4 shows a simplified longitudinal section through the drum in which the shaft or trunnions 14 are omitted. A rotary joint, generally indicated at 70, is in communication with a supply of treating fluid through duct or pipe 82. The rotary joint consists of a stator 72 and rotor 74. The rotor, in turn, communicates with distribution pipes 76 which run to orifices 80 passing through the drum surface. A check valve or seal assembly 81 prevents back flow of treating fluid into the supply line.

Figure 5A:
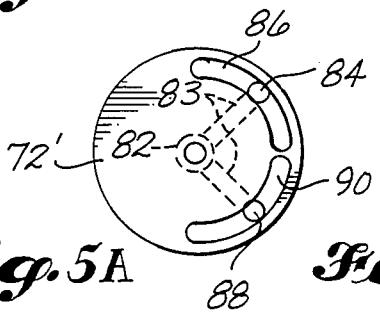
FIG. 5A is a section taken along line 5—5 of FIG. 4 showing a stator suitable for two-stage fluid treatment.
Figure 5B:
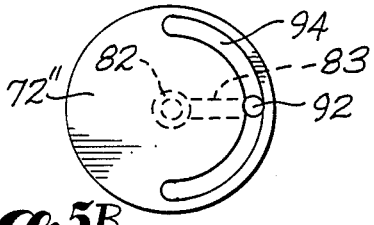
FIG. 5B is a section taken along line 5—5 of FIG. 4 showing a stator suitable for one-stage fluid treatment.

FIGS. 5A and 5B show versions of the rotary joint useful respectively for two-stage and single-stage treatment. In FIG. 5A the stator member 72' has ducts 83 connecting with orifices 84, 88 emptying into milled distribution slots 86, 90. In this case each of the two treatment zones will cover 90° of drum surface. It will be understood that a plurality of treating fluid supply ducts 82 could be used so that different fluids could be supplied to distribution slots 86, 90 as, for example, would be necessary for a countercurrent type of treatment. The version shown in FIG. 5B has only a single fluid distribution duct 83 opening into orifice 92 into distribution slot 94. In this version of the device the treatment zone will encompass 180° of drum surface. Rotary valves of this type are conventional and, per se, form no part of the present invention.

Figure 6:
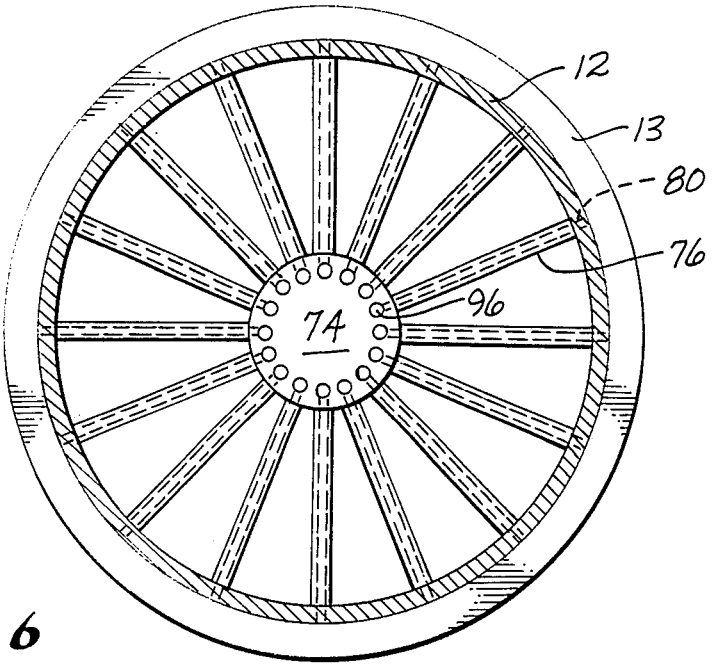
FIG. 6 is a section taken along line 6—6 of FIG. 4 showing a rotor element for the liquid distribution system.

FIG. 6 is a cross section through line 6—6 of FIG. 4 and shows rotor section 74 containing fluid ingress orifices 96 and a plurality of spoke-like radial distribution ducts 76 connected to orifices 80 passing through drum shell 12. This portion of the device is essentially the same regardless of whether the apparatus is configured for only one or for multiple treatment stages as long as there is at least one distribution duct 76 in communication with each treatment zone at all times.

Figure 2:
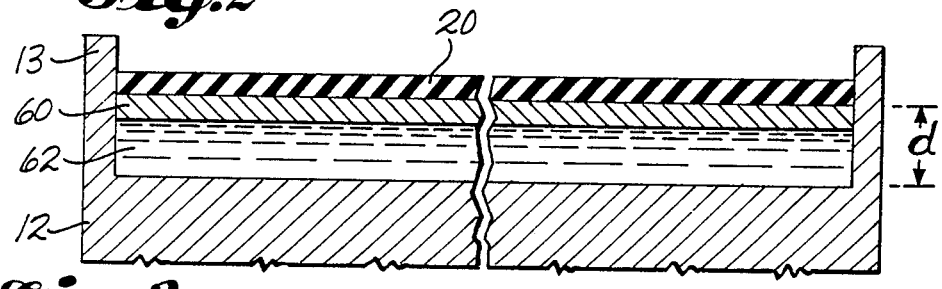
FIG. 2 is a section taken along line 2—2 of FIG. 1.

FIGS. 2, 3, 7, and 8 show various sectional views and optional configurations of the web treating apparatus in operation. In FIG. 2 the mat 60 being treated lies between drum 12 and belt 20. The mat is shown here pressed against the drum-facing surface of belt 20 leaving a gap 62 between the drum-facing surface of mat 60 and drum 12. In the illustration gap 62 is filled with treating fluid and represents a pool of fluid underlying the mat over substantially the entire treatment zone except for the areas immediately adjacent the press or nip rolls. Position control roll 34 must be adjusted to permit this pool to form. Otherwise, there will not be a uniform distribution of treating fluid under the mat.

Figure 3:
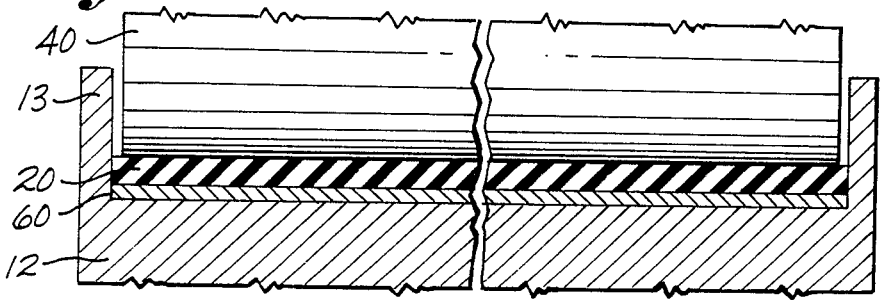
FIG. 3 is a section taken along line 3—3 of FIG. 1.

FIG. 3 shows the mat as it passes beneath the upper nip roll 40. Here the mat is compressed and forms a barrier against fluid passing out of the treating zone between the mat and the drum.

In FIGS. 2 and 3 belt 20 is shown abutting flanges 13 on the edge of roll 12. It is essential that this or some other kind of marginal seal is present to prevent loss of treating fluid from the edges of the belt. If this loss occurred to any extent it would be unacceptable and the apparatus would not work as intended. FIGS. 7 and 8 are similar to FIG. 2 but show other forms of marginal seals. In FIG. 7 a resilient seal 100 is affixed to the edges of belt 20 and serves to present a larger area for blocking fluid loss against flange 13. A somewhat different arrangement is shown in FIG. 8 where seal 102 is a separate member seated in grooves 104 machined in the edges of drum 12. No flanges are required on the drum in this case. This type of seal is well suited for the treatment of thin webs using small overall gap dimensions. Other types of edge seal arrangements will be readily apparent to those skilled in the art.

FIG. 9 shows a modified drum surface in which drum 12 has a regular series of raised ridges or corrugations 106. These ridges serve to reduce the flow of treating fluid from the nip zone back into the treating zone as web 60 passes through nip zone 54. Preferably these ridges are essentially equidistantly spaced and located parallel to the longitudinal axis of the drum.

It is desirable to have a check valve mechanism associated with orifices 80 to prevent any backflow of treating fluid into the supply source. This could potentially occur as the drum and treated web pass through one of the nip zones. FIGS. 10–14 show two simple and effective mechanical arrangements which serve the function of check valves. In FIG. 10 a resilient belt or spring-like member 110 is attached circumferentially around the drum overlying the mouths of orifices 80. This resilient member may be attached in a number of ways. In the present case bolts or similar fastening means 112 with washers 114 serve to attach resilient member 110 to the drum. This construction is shown in cross section in FIG. 11. It should be noted that the representation pictured in FIG. 10 presumes that the drum is passing through a treating zone and that fluid pressure, exerted by the treating fluid emerging from the orifice 80, has raised resilient member 110 away from the drum to permit passage of fluid into the treating zone.

A somewhat different and preferred configuration is shown in FIGS. 12 and 13. Here the resilient member 118, serving as a check valve, is retained within a channel or groove 119 formed in the surface of roll 12. This channel preferably has sloping side walls 120 which will more readily permit the passage of treating fluid when the resilient member 118 is lifted by fluid pressure. As is seen in FIG. 12 member 118 is pressed tightly against and acts as an effective seal for orifices 80 as the assembly passes through a nip zone 54.

Figure 14:
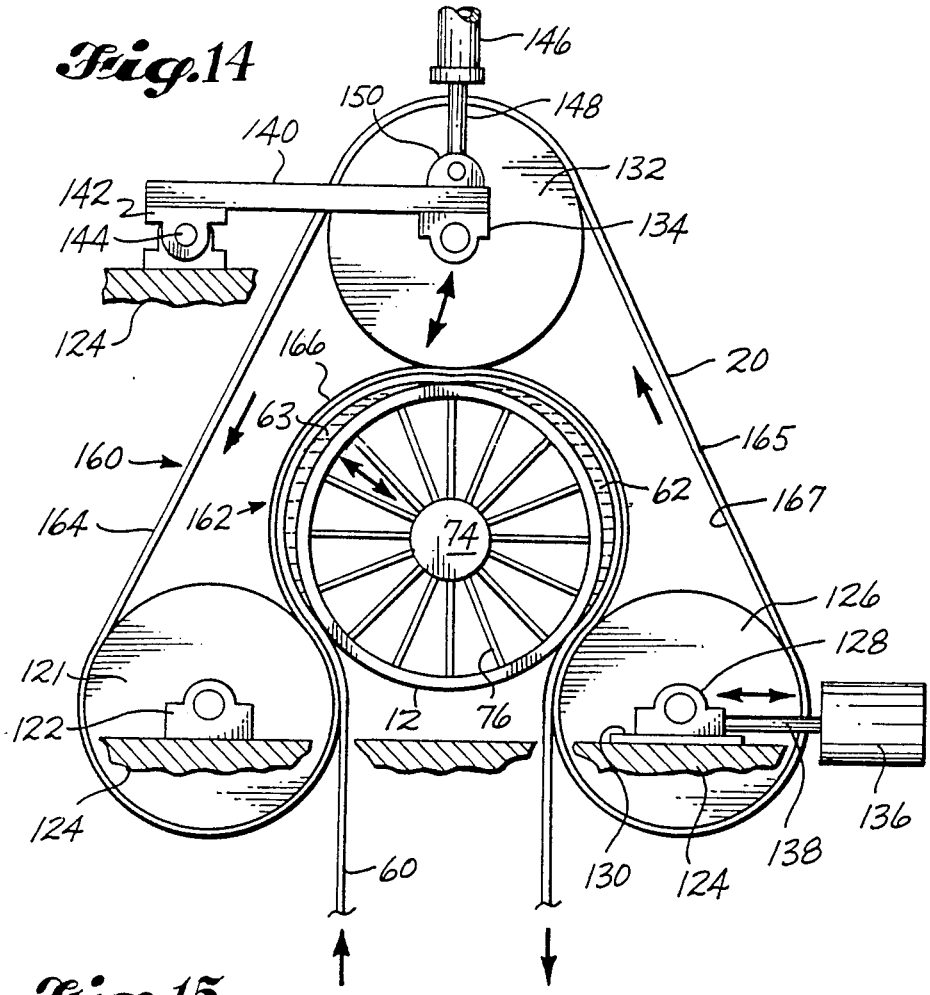
FIG. 14 is a representational side elevation view of a two-stage treating apparatus using a free floating drum.

A somewhat different configuration of the mat treatment device is shown in FIG. 14. Here there are no idler rolls within the belt loop other than those which also serve as press rolls to create nips with the drum. In this version a fixed press roll 121 and a movable press roll 126, spaced some distance from it, serve the dual function of belt position control and drum support. Position control press roll 121 is journalled in bearing 122 which may be anchored to frame member 124. Belt position control roll 126 is journalled in bearing 128. Bearing 128 rides on track 130 anchored to frame 124. The position of roll 126 can be adjusted with respect to that of roll 121 by translating it a limited distance with a translating mechanism 136 operating through a connecting rod 138. Translating mechanism 136 is very conventional and can be a fluid cylinder, a rack and pinion or similar gear arrangement, or other well known means. It should be considered within the scope of the invention to have a similar mechanism on roll 121 so that both rolls are moved simultaneously and equidistantly. Drum 12 may be shaftless and ride in free floating fashion on press rolls 121, 126 if the spacing between these rolls is limited to a distance less than the drum diameter. At least one additional press roll must be provided. In the present example idling press roll 132 is journalled in bearing 134. This is mounted on a lever arm 140 in turn connected by a bearing 142 and pin 144 to frame member 124. Roll 132 must be free to move radially with respect to drum 12 if the position of the drum should change due to variation in distance between the belt position control rolls 121 and 126. In similar fashion, drum 12 must itself be free to adjust position. It is for this reason that a free-floating drum is a preferred configuration.

Belt 20 is configured into a closed loop with an outer run 164 generally having the configuration of a triangle and an inner run 166 generally in the configuration of the Greek letter Ω. The belt loop itself has an outer face 165 and an inner face 167. Outer face 165 is reeved around the drum 12 while all of the press rolls 121, 126, 132 are enclosed within the belt loop and in contact with inner face 167. The rolls create three nip zones which, in turn, define two treatment zones 62, 63. A web of material 60 is shown passing around drum 12 and through the two treatment zones.

Figure 16:
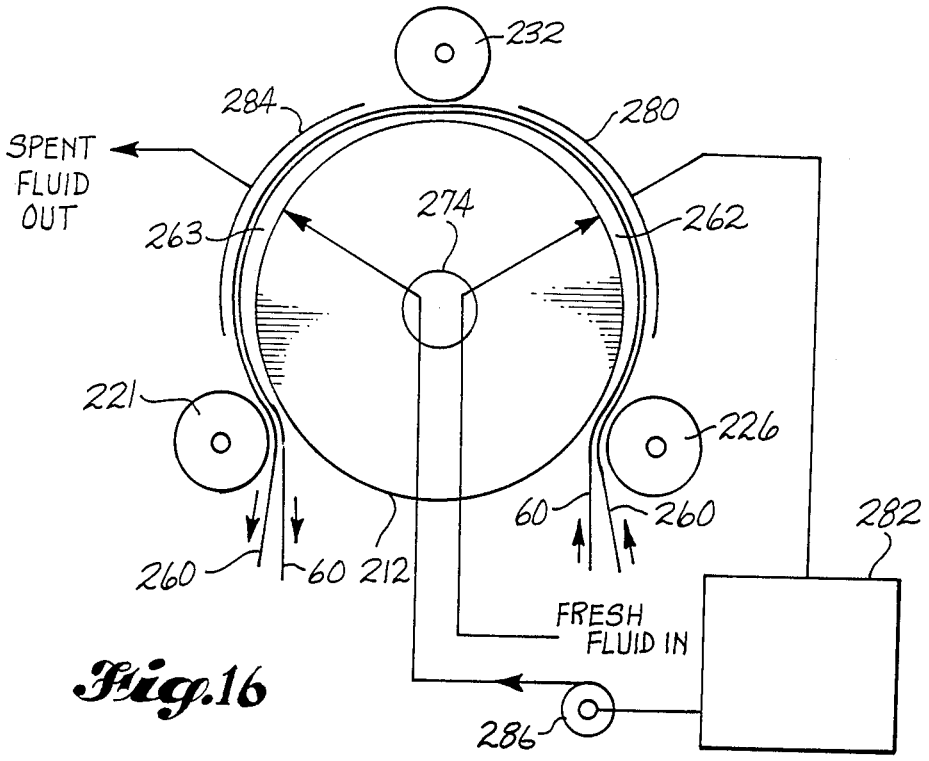
FIG. 16 is a diagrammatic illustration showing two stage treatment of a web using recycled fluid in a device of the type shown in FIG. 14.

FIG. 16 shows diagramatically how the apparatus could be used for two stage countercurrent or concurrent treatment of a web using expressed fluid from one treatment zone which is returned to the other treatment zone. The drum 212 has a fixed press roll 221 and a moveable press roll 226. An idling press roll 232 is mounted above and between them. The belt is not shown in this figure and it is presumed that the device to this point is identical to the one shown in FIG. 14. An appropriate state of the art fluid collection hood 280 is mounted over the treatment zone between rolls 226 and 232 and a similar hood 284 is mounted over the treatment zone between rolls 221 and 232. Fluid expressed from the first of these treatment zones is collected by hood 280 and directed into a holding tank 282. From there it is returned by pump 286 to the second treating zone. Hub 274 is appropriately modified to handle the two liquid streams.

The gap between the belt and the drum in the treatment zones is controlled by the relative position of press rolls 121 and 126. As the rolls move relatively further apart the gap is increased whereas the gap is narrowed if the spacing between the rolls is decreased.

The fluid supply system for the drum and the belt margin seals are similar or identical to those described for the configuration shown in FIGS. 1, 7, or 8.

One advantage of the configuration shown in FIG. 14 is its simplicity of construction. No additional idler rolls are used other than those which also serve as nip rolls forcing the belt into contact with the drum. Further, the fact that the drum is free-floating simplifies drum construction. The drum is not subject to axial bending loads, therefore, it can be of relatively lighter construction. The machine frame construction is also simplified. Drum position can be readily maintained by well known means such as rollers acting against the edges. Conventional means are also available for assuring proper belt tracking.

Materials of construction will depend entirely on the use for which the apparatus is intended. For some applications, such as applying bleaching chemicals to the web of material, corrosion resistant metals or plastics may be needed. In this case the belt is preferably a fabric mesh made of nylon or similar durable plastic material. Belts of this type are available from a number of manufacturers. One such manufacturer is the Appleton Wire Division of Albany International, Appleton, Wisconsin. Where corrosion is not a problem, it may be desirable to use a wire mesh belt. Belts of this type are also available from a number of vendors of which the Maryland Wire Belt Company, Church Creek, Md. is an example. The above vendors are mentioned only as examples and not in any way as an endorsement of their products over those available from other manufacturers.

It is evident from reference to FIG. 14 that considerable pressure will be placed on idling nip roll 132 by the outer run 160 of the belt loop. Additional nip force can be gained by further loading idler press roll 132 by means of a fluid cylinder 146 acting through piston rod 148 and connecting link 150.

It should be considered within the scope of the invention to use generally similar units of the present apparatus in sequence so that a web may be discharged from the treating zone of a first apparatus and, without significantly altering its integrity, pass into the treating zone of a second apparatus.

Figure 15:
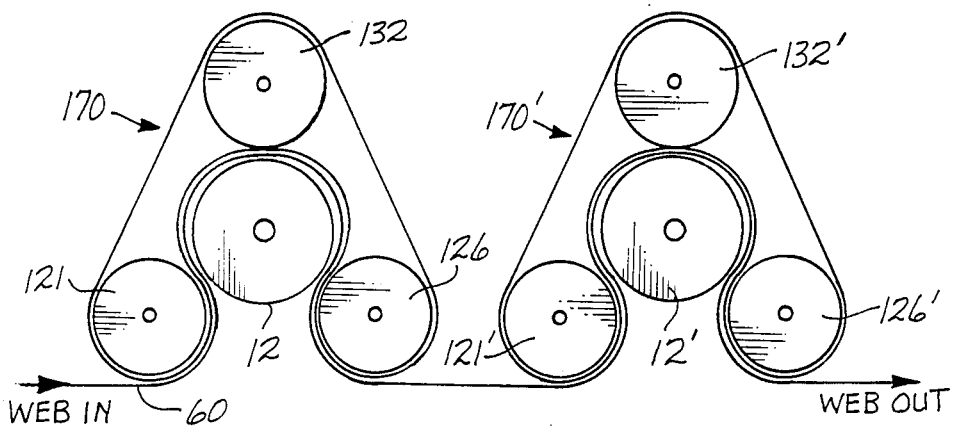
FIG. 15 is a diagrammatic illustration showing sequential treatment of a web using two of the devices of FIG. 14 in series.

FIG. 15 is illustrative of an arrangement of this type where identical treatment apparatuses 170, 170', of the type shown in FIG. 14, are used in series. Any of the other embodiments shown could be used in the same manner. In another variation the web may be used as a filter medium to remove particulate material from the treating fluid. The web to be treated may be drawn from a broad variety of materials formed in different manners. They may be fabrics or felts formed of natural or synthetic fibers which have been either dry-formed or wet-formed. The only requirement of the webs is that they possess sufficient integrity to remain in web form as they pass into and through the treating apparatus.

Many variations over and above those described in the examples will be readily apparent to those skilled in the art. It is the inventor's intention that the scope of the invention be limited only by the appended claims.

What is claimed is:

1. Apparatus for treating a permeable web with a fluid which comprises:

a rotatable drum means, said drum means having an apertured surface with the apertures being in communication with a fluid supply means;

a fluid permeable endless belt means reeved about the drum means, said belt means having a drum facing surface and an outer surface;

at least two spaced apart press roll means bearing against the outer surface of the belt means and forcing it against the drum means to form nip zones;

belt position control means allowing the belt means limited freedom of radial movement away from the drum means between the nip zones in order to form a gap between the belt means and drum means, said belt and drum means defining a volume comprising a permeable web treating zone in the gapped region between said nip zones;

a fluid supply means to supply treating fluid under pressure outwardly through the surface apertures in the drum means into the treating zone between the press roll means; and belt margin seal means acting between the belt means and drum means to prevent treating fluid leakage between the marginal portions of said belt and drum means;

whereby the fluid permeable web of material to be treated may be continuously passed between the moving belt and rotating drum, and treating fluid under pressure may be directed outwardly through the drum apertures against the drum facing surface of the web in the treating zone, said treating fluid then passing outwardly through the web and permeable belt means in the treating zone and being generally pressed from the web as the web exits the treating zone through a nip zone.

2. The apparatus of claim 1 in which at least three spaced apart press roll means bear against the outer surface of the drum to create a plurality of sequential treatment zones.

3. The apparatus of claim 2 including treating fluid recycling means to collect expressed fluid from one treatment zone and return it to another treatment zone.

4. The apparatus of claim 2 in which the treating zone area encompasses more than half the circumference of the drum.

5. The apparatus of claim 4 in which the drum means is free floating and is supported solely by the press roll means.

6. The apparatus of claim 5 in which the press roll means at each end of the treating zone area are relatively translatable a limited distance toward or away from each other to control belt position.

7. The apparatus of claim 1 in which the fluid supply means includes a rotary valve.

8. The apparatus of claim 7 in which the rotary valve is segmented to supply treating fluid to sequential treating zones.

9. The apparatus of claim 1 in which the drum surface apertures include check valves to prevent return flow of treating fluid.

10. The apparatus of claim 9 in which the surface apertures are located on a common circumferential line around the drum surface.

11. The apparatus of claim 10 in which the check valves comprise a deformable band encircling the drum surface in an area overlying the surface apertures, whereby said band can move away from the apertures due to pressure from applied treating fluid to permit the flow of said fluid into a web treating zone.

12. The apparatus of claim 11 wherein the deformable band is located in a channel formed in the drum surface so that the outer surface of the band is essentially flush with the drum surface.

13. The apparatus of claim 12 wherein said channel has outwardly sloping sidewalls to provide a passage for treating fluid around the edge of the band when the pressure of the fluid moves the band away from the apertures.

14. The apparatus of claim 1 in which the drum surface has essentially equidistantly spaced projecting ridges located parallel to the longitudinal axis of the drum, said ridges serving to reduce flow of treating fluid from the nip zone into the treating zone as a treated web passes under a press roll when leaving said treating zone.

15. The apparatus of claim 1 in which the drum has a radially projecting flange at each end, said flanges acting with the edges of the endless belt means to form the seal means at the belt margins.

16. The apparatus of claim 1 in which the treating zone area encompasses more than half the circumference of the drum.

17. The apparatus of claim 16 in which the drum means is free floating and is supported solely by the press roll means.

18. The apparatus of claim 17 in which the press roll means at each end of the treating zone area are relatively translatable a limited distance toward or away from each other to control belt position.

19. Apparatus for treating a permeable web with a fluid which comprises:

a rotatable drum means, said drum means having an apertured surface with the apertures being in communication with a fluid supply means;

two spaced apart belt position control press roll means adjacent the drum means and having longitudinal axes parallel to the longitudinal axis of the drum means, said press roll means being relatively translatable a limited distance toward or away from each other, the distance between the position control press roll means always being less than the diameter of the drum means so that they divide the drum circumference into into major and minor portions with said major portion encompassing more then 180° of angle, at least one idling press roll means located adjacent the drum along the major portion of the drum circumference between the position control press roll means;

a looped fluid permeable endless belt means having an outer face and an inner face, a portion of the outer face of the looped belt being reeved about the drum means so that it contacts said major portion of the drum circumference, the belt position control press rolls and idling press roll or rolls being located within and contacting the inner face of the looped belt means, all of said press roll means urging the belt means against the drum means so as to form nip zones therebetween, said belt position control press rolls being located to give the belt means limited freedom of movement away from the drum means in the area between the nip zones in order to form gaps between the belt means and drum means and define volumes comprising permeable web treating zones, said gap distances and treating zone volumes being determined by the spacing between the position control roll means, a fluid supply means to supply treating fluid under pressure outwardly through the surface apertures in the drum means into the treating zones; and belt margin seal means acting between the belt means and drum means to prevent treating fluid leakage between the marginal portions of said belt and drum means;

said drum means being free to move so as to maintain full contact with both belt position control roll means at any time when the distance between them may be changed, and said idler press rolls being free to move radially so as to maintain full contact against the drum during such movements, said idler press roll means further functioning to maintain belt spacing within the belt loop, said belt means continually exerting a radially directed force against the idler press roll means to urge said roll means against the nip zone, whereby the fluid permeable web of material to be treated may be continuously passed between the moving belt and rotating drum, and treating fluid under pressure may be directed outwardly through the drum apertures against the drum facing surface of the web in the treating zone, said treating fluid then passing outwardly through the web and permeable belt means in the treating zone and being generally pressed from the web as the web exits the treating zone through a nip zone.

20. The apparatus of claim 19 in which the belt loop is supported solely by the drum means and position control and idling press roll means.

21. The apparatus of claim 19 which includes supplementary nip force means acting against the idler press roll means to increase the nip force over and above that provided solely by belt tension.

22. A method of processing a fluid permeable web which comprises:

providing a web treatment zone by reeving a fluid permeable endless belt means around a drum means having an apertured surface with the apertures being in communication with a fluid supply means, said belt means being radially displaced from the drum means in the treatment zone to provide a gap therebetween, said treatment zone being defined in part by angularly spaced apart press roll means acting against the belt and drum means to form fluid retaining nip zones, and being further defined by belt margin seal means acting between the belt means and drum means to prevent fluid leakage between the marginal portions of said means;

driving the drum and belt means to obtain rotation of the drum means;

continuously passing the fluid permeable web between the drum and belt means so that it moves through the treating zone and the nip zones;

adjusting the gap between the belt and drum means in the treating zone so that they are separated a sufficient distance to allow a pool of treating liquid to form between the drum means surface and the web of material being treated and permit treating fluid flow within the pool; and injecting treating fluid under pressure into the treating zone through the drum apertures so that said fluid passes through the permeable web and endless belt means.

23. The method of claim 22 which further includes discharging the web from the treating zone of a first apparatus and without significantly altering the integrity of the web passing the web into the treating zone of a second and similar apparatus.

24. The method of claim 22 in which the web serves as a filter medium to remove particulate material from the treating fluid.

* * * * *